US005427199A

United States Patent [19]

Jorgensen et al.

[11] Patent Number: 5,427,199

[45] Date of Patent: Jun. 27, 1995

[54] SELF-PROPELLED WORK PLATFORM AND CONTAINMENT ENCLOSURE

[75] Inventors: Clay Jorgensen, Stanwood; Marl Kane, Auburn; Don Sybil, Kent, all of Wash.

[73] Assignee: Interstate Coatings Inc., Seattle, Wash.

[21] Appl. No.: 52,066

[22] Filed: Apr. 22, 1993

[51] Int. Cl.[6] ..... B24C 9/00

[52] U.S. Cl. ..... 182/142; 182/2; 451/89

[58] Field of Search ..... 182/142, 150, 129, 2; 51/410, 424, 426, 429

[56] References Cited

U.S. PATENT DOCUMENTS

| | | | |
|---|---|---|---|
| 2,998,094 | 8/1961 | Fisher | 182/142 |
| 4,429,764 | 2/1984 | Park | 182/129 |
| 4,649,672 | 3/1987 | Thomann | 51/426 X |
| 4,825,598 | 5/1989 | Schlick | 51/426 X |
| 4,854,419 | 8/1989 | Lyras et al. | 182/129 |
| 5,011,710 | 4/1991 | Harrison | 427/142 |
| 5,038,527 | 8/1991 | Fastje | 51/426 |
| 5,065,839 | 11/1991 | Napier | 182/47 |
| 5,067,504 | 11/1991 | Coleman, III | 134/172 |

FOREIGN PATENT DOCUMENTS

| | | | |
|---|---|---|---|
| 119012 | 10/1944 | Australia | 51/424 |

*Primary Examiner*—Alvin C. Chin-Shue
*Attorney, Agent, or Firm*—Seed and Berry

[57] ABSTRACT

A moveable, rigid enclosure having a work platform enclosed therewithin and which is sealed against a work surface. A negative pressure is applied to the interior of the enclosure. The rigid enclosure is supported by the inner work platform, and includes a funnel-shaped bottom portion coupled to a conduit for collecting and transporting of spent blast materials and debris contained within the enclosure which is released during blasting of the work surface. Blast media is supplied to the worker by a supply conduit extending interior of the rigid enclosure. A controller is positioned within the enclosure by which the worker while within the enclosure can adjust the vertical or horizontal position of the enclosure.

27 Claims, 4 Drawing Sheets

SELF-PROPELLED WORK PLATFORM AND CONTAINMENT ENCLOSURE

DESCRIPTION

1. Technical Field

The present invention relates to work platforms and, more particularly, to self-propelled enclosed work platforms.

2. Background of the Invention

Routine maintenance of large structures, such as bridges, ships, and buildings, has become prohibitively expensive for private owners as well as for the state and federal government. Routine maintenance that can add many years to a structure's operational life includes cleaning, stripping, painting, or other surface treatments. Many treatments involve blasting, grinding, or spraying with metallic slags, steel shot, garnet, sand, or other abrasive materials. These materials impact the structure, dislodge contaminants, and fall to the ground along with the contaminants. Other cleaning or renovation processes use high-pressure water or other fluid to blast and wash particles away from the structure. Reapplying paint usually involves spraying the structure with paint, thereby resulting in overspray and release of paint and volatile contaminants to the environment.

A substantial amount of environmentally toxic or otherwise objectionable material and overspray is usually generated by these maintenance processes. For example, municipal water tanks are usually stripped and prepared for painting by sandblasting the old paint off the structure to expose the underlying metal. This process results in a clean structure while releasing toxic paint and sandblasting particulates into the atmosphere, the ground, and possibly the ground water. Similarly, when paint is applied to the tank, paint and its volatile components enter the atmosphere and settle onto the surrounding area. The necessary clean-up of the area around the water tank is expensive, time-consuming, and cumbersome. However, such clean-up is often not thorough enough to prevent contamination of the surrounding environment. With environmental concerns and regulations, such routine maintenance is extremely expensive and sometimes not economically possible.

A variety of processes have been attempted in the past to alleviate these problems. For example, lead paint removal from municipal water tanks involved shrouding the entire water tank in a tent, applying a negative pressure inside the tent to prevent paint chips and dust from escaping, and sandblasting the tank. However, the paint and sand not trapped by a filter system coupled to the tent landed on the ground within the tented area.

Another method, as seen in U.S. Pat. No. 4,429,764 (Park), utilized a partially enclosed scaffolding with troughs mounted below the scaffolding platform to capture sandblasting residue. This scaffolding system, however, only encloses the scaffolding's sides and back with canvas walls, and leaves the top open. These canvas walls are subject to substantial wind disturbances and damage by errant blasts of sand. The open top allows airborne particulates to escape into the atmosphere.

Most work platforms used for maintenance operations may be moved, but such movement is not quick or convenient, and is not controllable by the worker on the platform. Adjusting the platform's position requires substantial time, manpower, communication and coordination between the platform workers and the platform movers. Although the Park scaffolding system is positioned and supported by cables and a pulley system mounted to the roof of a building, the system is not a self-propelled system controlled by the worker from the platform.

SUMMARY OF THE INVENTION

It is an object of the subject invention to provide a novel and improved complete enclosure around a self-propelled work platform when in position against a work structure.

It is another object of the subject invention to provide a rigid, blast-proof structure enclosing an attached work platform which may be controlled and positioned along a work structure by an enclosed worker.

It is another object of the subject invention to provide a self-propelled, rigidly enclosed work platform with an attached vacuum conduit to create a negative pressure within the enclosure and to contain all objectionable matter in the rigid enclosure.

It is another object of the subject invention to provide a self-propelled, rigidly enclosed work platform with a supply of breathable air available to a worker within the enclosure.

It is yet another object of the present invention to provide a self-propelled, rigidly enclosed work platform with a particle-collecting base coupled to a conduit to return expelled particulates and effluents to a debris collector and particulate separator system, thereby preventing all objectionable materials from escaping into the atmosphere or onto the ground.

In accordance with these and many other objects, the subject invention provides an enclosed work platform apparatus comprising a moveable work platform to support a worker, the platform being mounted within a rigid enclosure. The platform is completely and rigidly enclosed and forms a substantially air tight enclosure when positioned against a work structure. The enclosure comprises a top, a bottom, one or more side panels, an open side that faces and is positioned against the work structure, and a flexible seal attached to the enclosure about the perimeter of its open side. The rigid enclosure, which connects to the work platform, includes particle-collecting means, such as a funnel-shaped section, at the bottom of the enclosure to collect and distribute debris. A return conduit coupled to the funnel transports effluents and blasting or cleaning particles or liquid away from the rigid enclosure to a debris collector and particle separation system. Suitable blasting particles may then be cleaned and reused, and the debris disposed of in an environmentally safe and legal manner.

The work platform apparatus further includes a vacuum conduit coupled to the rigid enclosure to create a negative pressure in the enclosure. This negative pressure effectively prevents materials, solid or liquid, from escaping through a resulting fluid-tight seal between the rigid enclosure and the work structure. The vacuum conduit also withdraws and delivers airborne particulates from the enclosure to a filter system.

An air supply hose provides breathable air to the enclosed worker through a breathing apparatus, such as a mask or hood. A supply conduit is coupled to the rigid enclosure to deliver or transport particulates to a distributor mechanism. The distributor, such as a paint gun, sandblasting gun, or high-pressure water sprayer, is used by the worker during the maintenance process.

Support means that support or hold the work platform in position against the work surface is connected to the work platform. Adjustable legs or supports coupled to the rigid enclosure are provided to support the work platform and enclosure when positioned on the ground. View ports in the rigid enclosure allows for viewing into and out of the rigid enclosure. A hinged hatch on the enclosure's top panel may be opened by the worker to visually determine whether or when the work platform has achieved a proper position against the surface of the work structure.

The subject invention further includes a position-controlling means, such as a control module, coupled to the work platform and to moving means such that the enclosed worker may adjust the position of the work platform and the rigid enclosure relative to the work surface. Thus, the work platform becomes a moveable and self-propelled work platform fully enclosed by a rigid enclosure and the particular work surface against which the enclosure is positioned.

Further objects and advantages of the subject invention will become apparent from the following detailed description of the preferred embodiments taken in conjunction with the drawings.

DETAILED DESCRIPTION OF THE INVENTION

Figure 1:
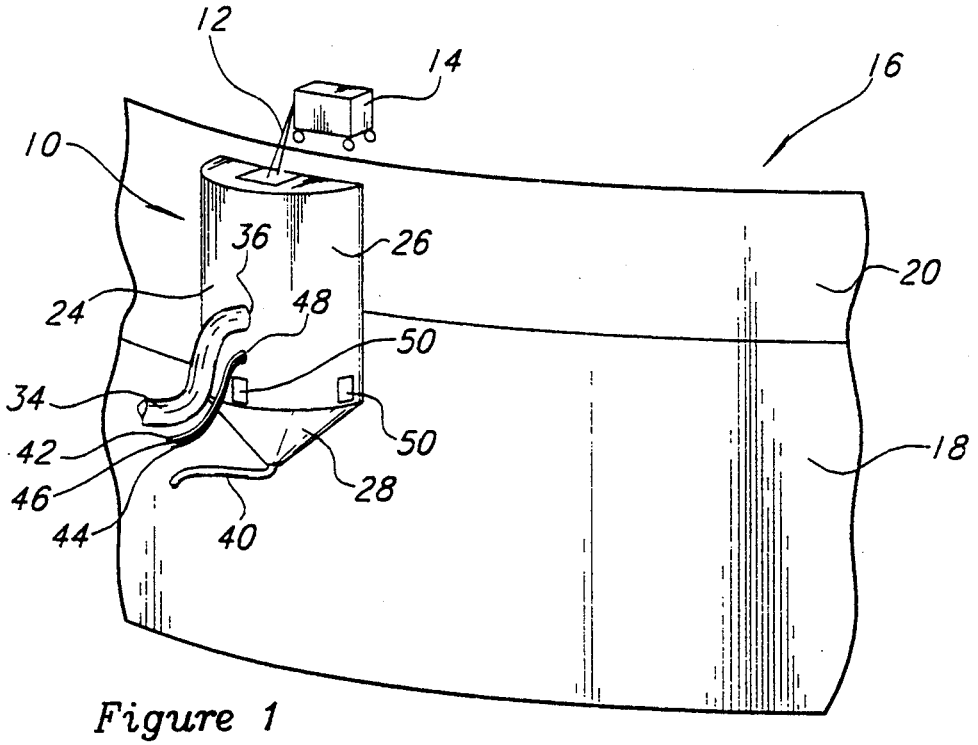
FIG. 1 is a perspective rear view of a rigid enclosure embodying the present invention shown without legs or skids positioned against a work surface.

Referring to FIG. 1, an enclosed work platform apparatus 10 according to the present invention is shown suspended by a pair of support cables 12 from a movable trolley 14. The apparatus 10 is shown positioned against a water tank 16 during a blasting operation. It is noted that the apparatus 10 may be supported when positioned against the water tank 16 by any suitable support means. The apparatus 10 is shown during use for removal of old paint 18 from the water tank 16, thereby exposing the bare metal of a circumferentially extending portion 20 of the water tank as the apparatus is moved about the tank.

Figure 2:
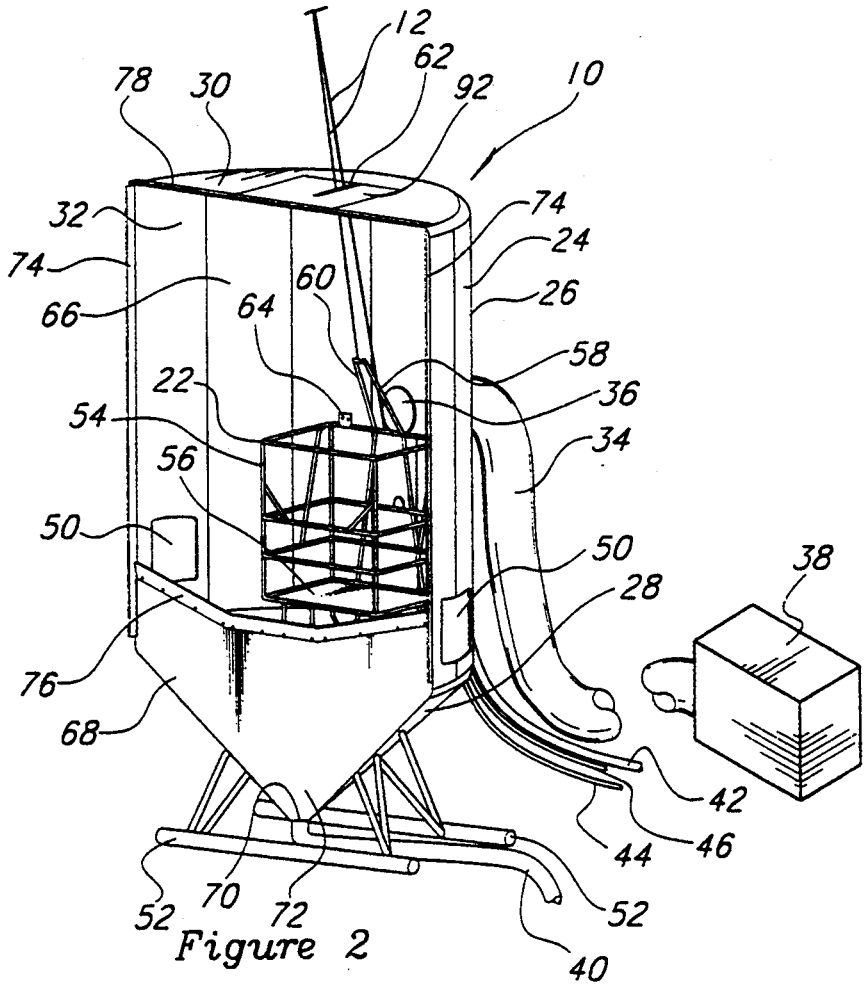
FIG. 2 is an enlarged perspective front view of the enclosure of FIG. 1 showing a work platform positioned within the enclosure and a pair of skids

The apparatus 10, shown without legs or supports in FIG. 1, is made up of several components. As best shown in FIG. 2, the apparatus 10 includes a work platform 22 completely enclosed within a rigid enclosure 24. When positioned against the water tank 16, a sealed enclosure is formed with the work platform 22 therein. In the preferred embodiment, the enclosure 24 has a rigid body portion 26 with the general shape of a cylinder split by a plane through its longitudinal axis, a downwardly pointing funnel-shaped particle collector 28 attached at the bottom of the body portion 26, and a top panel 30. The enclosure 24 has a front side opening 32 which provides a worker within the enclosure 24 with access to the surface of a portion of the water tank 16 on which work is to be performed, such as removal of old paint or application of new paint, when the enclosure is positioned against the water tank. In the work position, the wall of the water tank closes the front side opening 32 of the enclosure 24.

A vacuum conduit 34 communicates with the enclosure 24 through an orifice 36 in the rear of the enclosure. The vacuum conduit 34 also connects to a filtration system 38 (see FIG. 2) located on the ground at the base of the water tank 16. The filtration system 38 draws a vacuum through the conduit 34, thereby creating a slight negative pressure inside the enclosure 24 when positioned against the water tank 16.

Sand, high pressure water or other blasting material, paint debris, and other objectionable material from the blasting operation collects in the funnel collector 28. The blasting material and debris funnels into a return conduit 40 that transports the effluents to the filtration system 38, which includes a conventional debris collector and particle separator system. The separator system allows blasting particles to be cleaned and reused during the maintenance operation.

A pressurized supply conduit 42 is provided to transport the blasting material or paint to the enclosure 24. Accordingly, a worker standing on the platform 22 within the enclosure 24 blasts the structure while the enclosure is positioned against the water tank 16 to form a sealed, fully enclosed area with no escapement of the debris to the environment. Breathable air is supplied to the worker within the enclosure 24 through an air supply hose 44. Power supply and control lines 46 supply power to the enclosure 24 and allow control of the position of the enclosure 24, as will be described below. The power supply and control lines 46, air supply hose 44, and pressurized supply conduit 42 all enter the rigid enclosure 24 through an orifice 48 below the vacuum conduit 34.

View ports 50 are provided in the body portion 26 of the enclosure 24 to allow a person outside the enclosure to view the worker enclosed therein. Thus, if the worker requires emergency assistance while in the enclosure 24, the view ports 50 allow such need to be detected by an outside viewer.

In FIG. 2 the apparatus 10 is shown with support skids 52 coupled to the funnel collector 28 of the enclosure 24. The skids 52 are provided to support the enclosure 24 in an upright position when positioned on the ground.

The support cables 12 are securely fastened to the work platform 22, and the enclosure 24 is securely fastened to the work platform. In the preferred embodiment, the work platform 22 is a personnel basket, such as a "Spider" or "Skyclimber" lift. The work platform 22 comprises a plurality of tubular sections 54 welded or otherwise rigidly connected together, forming a basket around a standing plate 56 on which the worker stands.

The enclosure 24 is shown in FIG. 1 supported at a work structure by means of the support cables 12; however, support may also be provided by a boom arm, such as will be described below with respect to FIGS. 6 and 7, or by any other suitable system. In the embodiment of FIGS. 1–5, the support cables 12 suspend the enclosure 24 from the trolley 14 which is a remotely-controlled, moveable, wheeled lifting system attached by a radial cable to a centering ring on the top of the water tank 16, thereby holding the trolley 14 at a fixed radius and allowing it to travel circumferentially around the top outer edge of the water tank 16. As best shown in FIG. 2, the support cables 12 are attached to support members 58 and 60 which form a part of the work platform 22. The support cables 12 extend up from the support members 58 and 60, through a slot 62 in the top panel 30 of enclosure 24 and terminate at the trolley 14. The work platform 22 includes a cable climbing unit 61, such as an air or electric powered cable drum mounted under the work platform 22, attached to the cables 12 for vertical movement of the platform 22 and enclosure 24. It is noted that in the illustrated embodiment of the invention the apparatus 10 is supported by attachment of the support cables 12 directly to the work platform 22 and the enclosure 24 is a relatively lightweight structure which is directly supported by the work platform and only indirectly by the support cables.

A position controller 64 is mounted to the work platform 22 for access by the enclosed worker to control the horizontal and vertical movement of the platform 22, and hence, the movement of the enclosure 24 along water tank 16 as desired. The controller 64 is connected to the trolley 14 by a cable comprising one of the power supply and control lines 46. Accordingly, the apparatus 10 comprises a self-propelled work platform 22 controlled by the worker enclosed within the enclosure 24. By controlling the position of the enclosure along the work structure, the worker is able to quickly and easily move the enclosure 24 as the work progresses and to maintain better quality control through visual inspections while the work progresses.

In the embodiment illustrated in FIGS. 1–5, the controller 64 allows the enclosed worker to move the enclosure 24 vertically by ascending or descending along the length of the support cables 12 or laterally by moving the trolley 14 around the perimeter of the water tank 16.

The body portion 26 of the enclosure 24 includes three separate side panels 66 connected together. The front side of the funnel collector 28 has a flat panel portion 68 arranged below and generally coplanar with the front side opening 32 of the enclosure 24. During a blasting operation, blasting particles are transported from a supply source on the ground, through the pressurized supply conduit 42 to a blasting nozzle held by the worker inside the enclosure, and blasted against the portion of the water tank accessible through the front side opening 32 of the enclosure. The funnel collector 28 provides a cavity into which the abrasive blasting material and the debris dislodged from the water tank falls. The funnel collector 28 directs the material through an orifice 70 at the apex 72 of the funnel collector 28, at which the return conduit 40 is connected. The blasting material and debris enters the return conduit 40 and is transported to the separation system as mentioned above.

Flexible, flat blade seals 74, 76, and 78 are attached to the enclosure 24 around its front side opening 32 so that when the enclosure is positioned against the water tank 16 or any suitable other work surface, the seals contact the surface and form a substantially fluid-tight seal. Thus, when a negative pressure is applied to the rigid enclosure 24 via the vacuum conduit 34 by the filter system 38, seals 74, 76, and 78 form a barrier preventing the blasting materials, whether it be solid or liquid, and the debris dislodged thereby from escaping to the surrounding environment. Similarly, when the worker uses the enclosure 24 to apply paint, the paint is prevented from escaping to the environment.

In the preferred embodiment, the funnel collector 28, the top panel 30, and the side panels 66 of the enclosure 24 are constructed out of rigid, blast-resistant material, such as polyethylene (cross-linked or high-density). This material allows the enclosure 24 to easily withstand being hit by errant blasts or a peripheral blast pattern and suffer little, if any, damage. The material also provides a low-adhesion surface factor that easily releases most coating materials, e.g., paint. This preferred material further has a translucent characteristic allowing ambient light to provide a large portion of the illumination required inside the enclosure 24 for the worker to see in most blasting and restoration processes.

As seen in FIG. 2, the side panels 66 forming the body portion 26 of the enclosure 24 interconnect to form an aerodynamic, wind-resistant shape. The preferred semi-cylindrical shape eliminates many of the difficulties encountered with fabric-covered flat panel enclosures such as sudden platform shifts due to wind gusts. An aerodynamic, wind-resistant design becomes very important when working on the side of large structures, such as the face of a large building.

Figure 3:
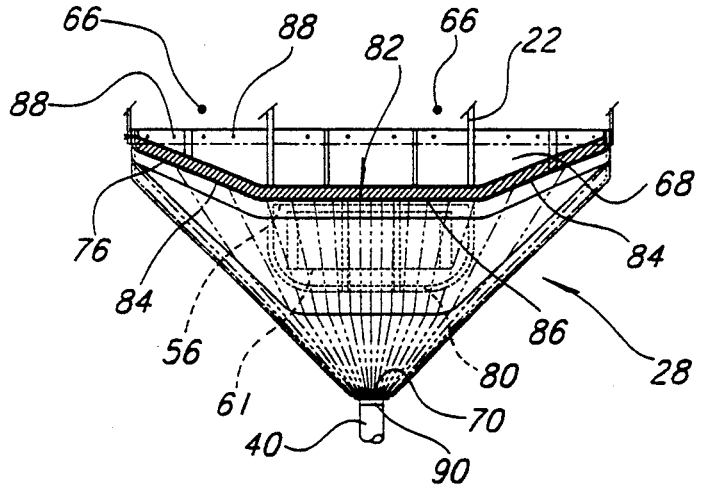
FIG. 3 is an enlarged fragmentary front elevational view of a bottom funnel portion of the enclosure of FIG. 2.

As seen in FIG. 3, a lower portion 80 of work platform 22 extends into the funnel collector 28 so that the standing plate 56 lies essentially along the same horizontal plane as a top edge 82 of the funnel panel portion 68. The preferred embodiment utilizes a funnel flat panel portion 68 with a top edge 82 having two downward sloping outer edge portions 84 and a horizontal middle edge portion 86, to increase the size of the front side opening 32 of the enclosure 24, and hence increase the work surface area of the water tank 16 accessible to the worker.

The seal 76 is attached to the funnel panel portion 68 at its top edge 82 with a plurality of fasteners, such as threaded bolts and wing nuts. The seal 76 is a flat member held at an upwardly tilting angle so that any material that lands on the seal will slide back toward the enclosure and fall into the funnel collector 28. The funnel panel portion 68 is securely attached to the remainder of the funnel collector 28 with a plurality of conventional fasteners. Similarly, a plurality of fasteners 88 secure the funnel collector 28 to a lower end portion of the side panels 66 of the body portion 26.

When installed, the interior walls of the funnel collector 28 slope downward toward the orifice 70. The funnel collector 28 has a flange 90 to which the return conduit 40 is attached. The low surface adhesion of the funnel collector material facilitates the funnelling action of blasting materials and debris for its passage through the orifice 70 into the return conduit 40.

Figure 4:
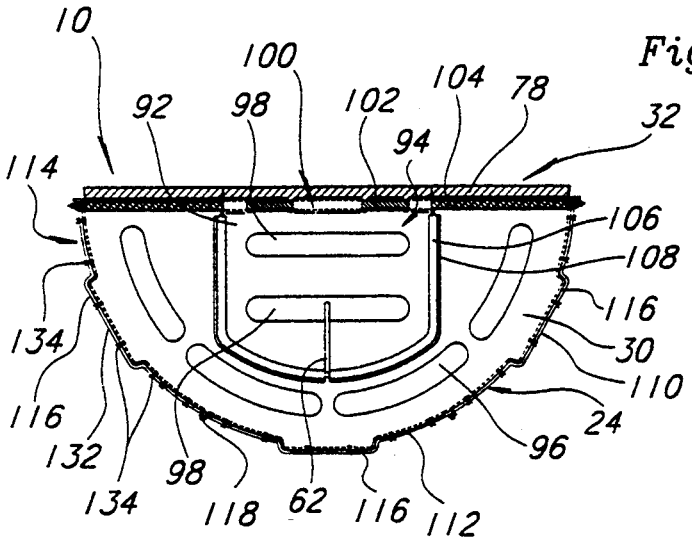
FIG. 4 is an enlarged top view of the enclosure of FIG. 2 showing a hinged hatch and the panel design.

As best shown in FIG. 4, the top panel 30 of enclosure 24 has a hinged hatch 92 (shown in the closed position) which covers an opening 94 in the top panel 30. Four indentations 96 are molded into the top panel 30 to provide structural reinforcement when negative pressure is applied within the enclosure 24. The hatch 92 also includes a pair of reinforcing indentations 98 for similar purposes and the slot 62 through which the support cables 12 extend. The hatch 92 has hinge portions 100 rotatably coupled to a stiffener tubing 102 along an upper edge 104 of the front side opening 32 of the enclosure 24. Accordingly, the hatch 92 can be pivoted between open and closed positions about the stiffener tubing 102.

When the apparatus 10 is operational, the hatch 92 remains in the closed position of FIG. 4, and is only opened for better visibility when the enclosed worker is repositioning the enclosure 24. While open, the worker can look through an opening 94 of the hatch 92 to determine the position of the enclosure 24 relative to the water tank, especially portions thereof located above the enclosure, such as overhangs.

When hatch 92 is in the closed position, a perimeter portion 106 of the hatch overlays a lip channel 108 extending about the hatch opening 94 in the top panel 30. This fit does not require a latching mechanism because the negative pressure in enclosure 24 during use sufficiently holds and seals the hatch 92 against the lip channel 108. Maintaining the negative pressure within the enclosure 24 is very important, but a sufficient negative pressure is maintained even though some air does flow through the slot 62 into the enclosure 24.

Figure 8:
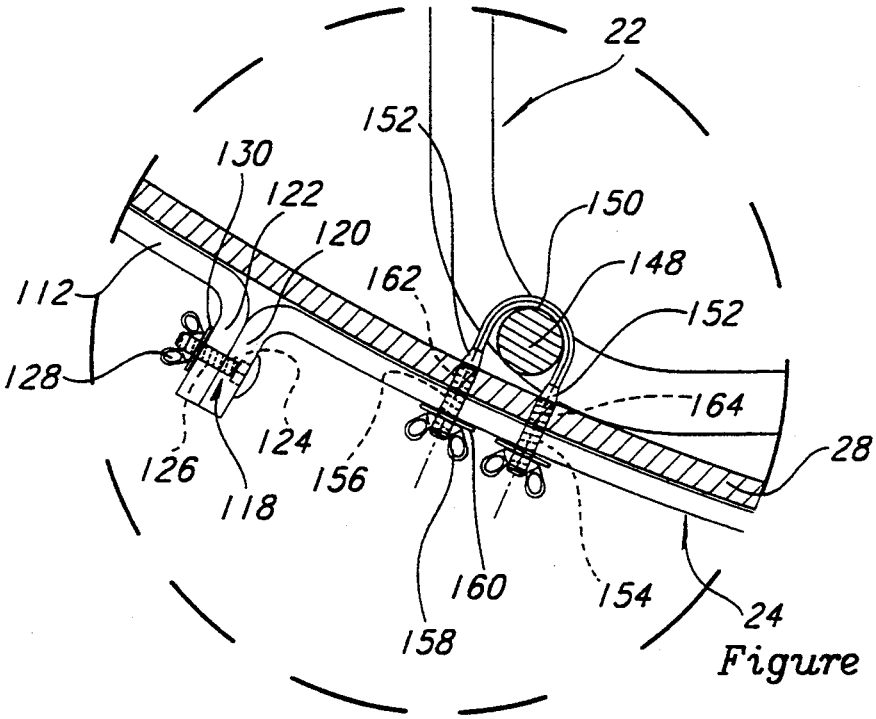
FIG. 8 is an enlarged, fragmentary top view of a fastener connecting two enclosure panels and a connector connecting the one enclosure panel and a frame member of the work platform of FIG. 2.

In the illustrated embodiment, the side panels 66 of the enclosure 24 includes three blast-resistant contoured panels 110, 112, and 114, coupled together to form a semicylindrical structure as best shown in FIG. 4. Each of its panels 110, 112, and 114 has a raised contour portion 116 molded into the panel to increase the panel's structural stiffness. Adjacent ones of the panels 110, 112 and 114 are connected together along their adjoining edge portions with a plurality of fasteners 118. As seen in FIG. 8, the panel 110 has a flanged edge portion 120 projecting outward perpendicular to the panel 110. The panel 112 incorporates a similar flanged edge portion 122. The panels 110 and 112 are connected by positioning the flanged edge portion 120 flat against the flanged edge portion 122, and installing the threaded fastener 118 into matting bores 124 and 126 formed into the flanged edge portions 120 and 122. In the illustrated embodiment, the fastener 118 is a carriage bolt with a wing nut 128 and washer 130 positioned thereon and tightened to form a secured juncture between the panels 110 and 112. The same connecting method is used between the panels 112 and 114.

The top panel 30 forms a cap-like structure that fits on top of and is fastened to the upper end portions of the panels 110, 112 and 114. The top panel 30 includes an outer, downwardly extending flange 132, best shown in FIG. 6 for a second embodiment of the invention, which directly overlaps the upper edge portions of the panels 110, 112, and 114. The top panel 30 is secured to the panels 110, 112 and 114 with fasteners 134 shown in FIG. 4, thereby forming a lap joint between the two components. In the preferred embodiment, fasteners 134 comprise a carriage bolt, a washer, and a wing nut, similar to those used to interconnect the panels 110, 112 and 114.

The seal 78 is mounted to the top panel 30 along the upper edge 104 of the front side opening 32.

Figure 5:
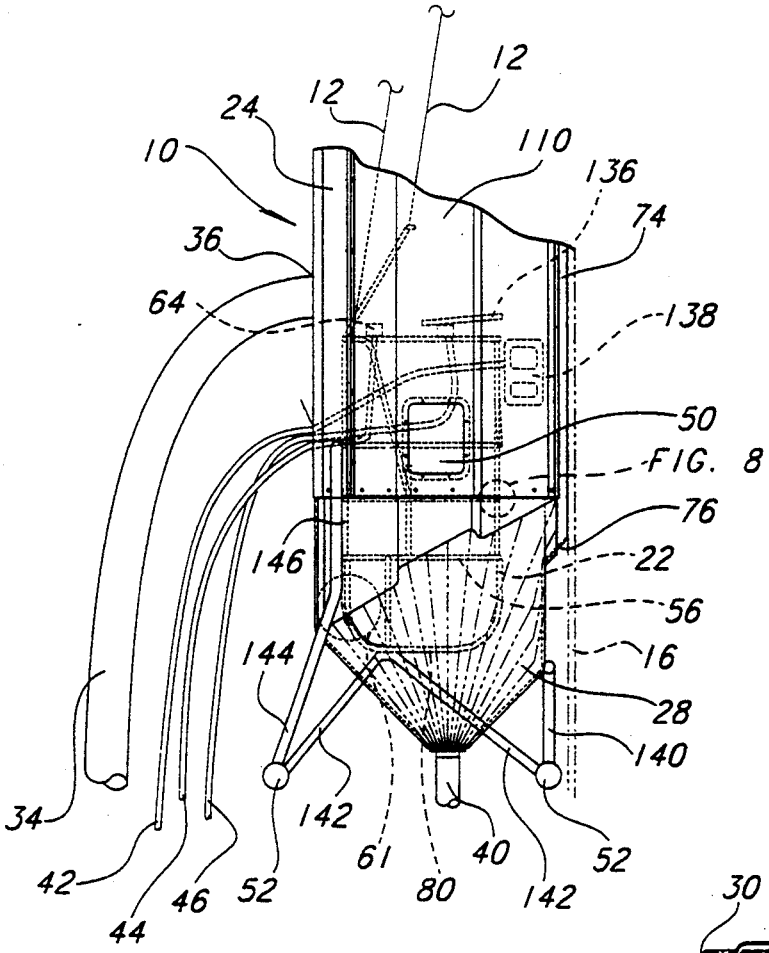
FIG. 5 is an enlarged, fragmentary side elevational view of the enclosure of FIG. 2 shown positioned against a work surface.

In FIG. 5, the apparatus 10 is shown against the water tank 16 with the seals 74 and 76 directly contacting the work structure of the water tank. The resulting debris barrier is sufficiently maintained by a negative pressure within enclosure 24 generated by drawing a vacuum through the vacuum conduit 34.

As best shown in FIG. 5, a nozzle 136, such as an abrasive blasting gun, high-pressure water gun, or paint sprayer, is coupled to the pressurized supply conduit 42 within the enclosure 24. The enclosed worker, standing in the work platform 22 on the standing plate 56, uses the nozzle 136 to blast or paint the work surface. For safety and health purposes, the worker is provided with a self-contained breathing apparatus 138 which is connected to the air supply hose 44 to provide the worker with breathable air. Other protective clothing and apparatus may be worn by the worker.

As best shown in FIG. 5, the enclosure 24 is supported, when positioned on the ground, by the skids 52 which are connected to the enclosure by tubular leg members 140, 142 and 144. Leg member 140 attaches to the funnel panel portion 68 of funnel collector 28 by conventional fasteners. Leg member 142 extends from the skids 52, through the funnel collector 28, to the lower tubular portion 80 of work platform 22. Leg member 144 extends through the funnel collector 28 and attaches to a back vertical tubular portion 146 of the work platform 22. The leg members 142 and 144 are secured to the work platform 22 by appropriate conventional fasteners.

The enclosure 24 is attached to the work platform 22 at a plurality of points. As seen in FIG. 8, the enclosure 24 is attached to a vertical tubular portion 148 of the work platform 22 by a U-bolt 150. The U-bolt 150 extends around the tubular portion 148 and has its parallel threaded legs 152 projecting through bores 154 and 156 in the panel 110 of the enclosure 24. The panel 110 is securely attached to the work platform using wing nuts 158 and washers 160. When attaching the enclosure 24 to the lower portion 80 of work platform 22, as is shown in FIG. 8, the legs 152 of the U-bolt 150 also through project bores 162 and 164 in the funnel collector 28.

Figure 9:
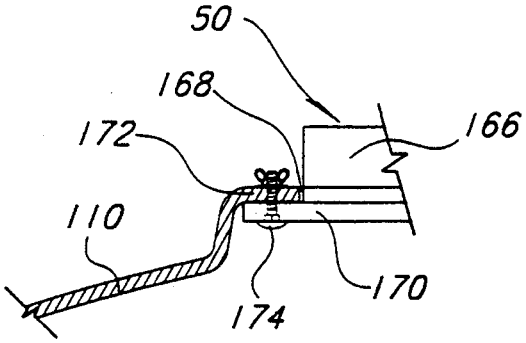
FIG. 9 is an enlarged, fragmentary top view of an interface between a side panel and view port of the enclosure of FIG. 2.

Referring now to FIGS. 5 and 9, the view port 50 is shown installed in the contoured panel 110. In the illustrated embodiment, view port 50 comprises a rectangular plate 166 of transparent, blast-resistant material. The view port 50 is secured to the contoured panel 110 and covers a corresponding opening 168 in the contoured side panel 110. The transparent plate 166 is mounted to a perimeter flange 170 positioned interior of the enclosure 24 with the transparent plate 166 extending through the opening 168 of the contoured panel 110. The perimeter flange 170 is secured to a perimeter flange portion 172 of the panel 110 surrounding the opening 168 using fasteners 174, thereby creating a sufficient seal to prevent excessive air leakage.

Figure 10:
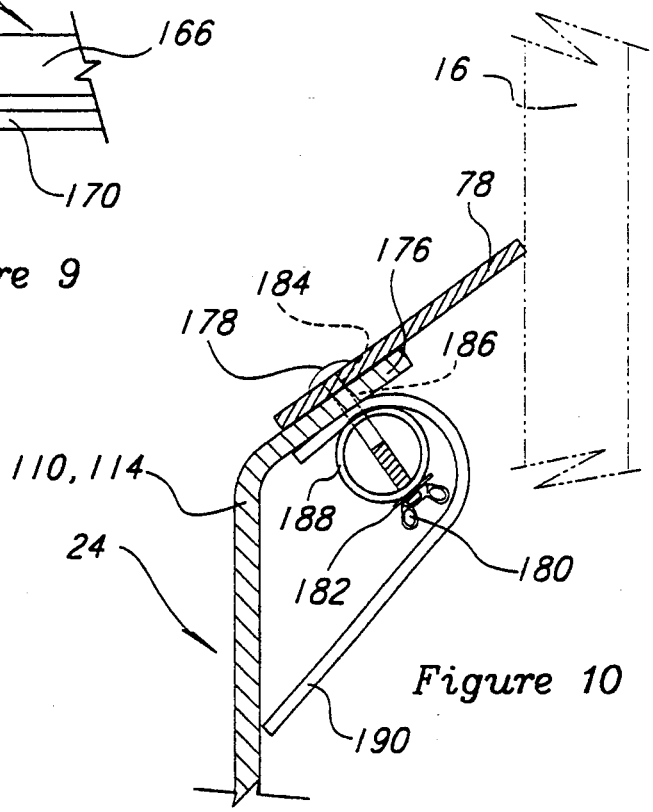
FIG. 10 is an enlarged, fragmentary top view of a blade seal carried by the enclosure of FIG. 2 in sealing contact with the work surface.

Referring to FIG. 10, the enclosure 24 includes two seals 78 which are positioned to the left and right sides of the front side opening 32 and extended vertically. Each of the seals 78 is attached to a corresponding perimeter flange portion 176 of either the panel 110 or 114 by a plurality of carriage bolts 178 using mating wing nuts 180, and washers 182. In the illustrated embodiment, the carriage bolt 178 extends through a bore 184 in the seal 78 and through a bore 186 in the perimeter flange portion 176 of the contoured panel 110 or 114.

The carriage bolt 178 also extending through a vertical stiffener tube 188 which extends along the length of perimeter portion flange 176. A curved, sheet-metal plate 190 is secured between the perimeter flange portion 176 and stiffener tube 188 such that the sheet metal plate 190 wraps around and protects the stiffener tube 188, the threads of the carriage bolt 178, the washer 182, and the wing nut 180. The embodiment shown in FIG. 10 may be modified to eliminate the use of the stiffener tube 188 when desired.

Figure 7:
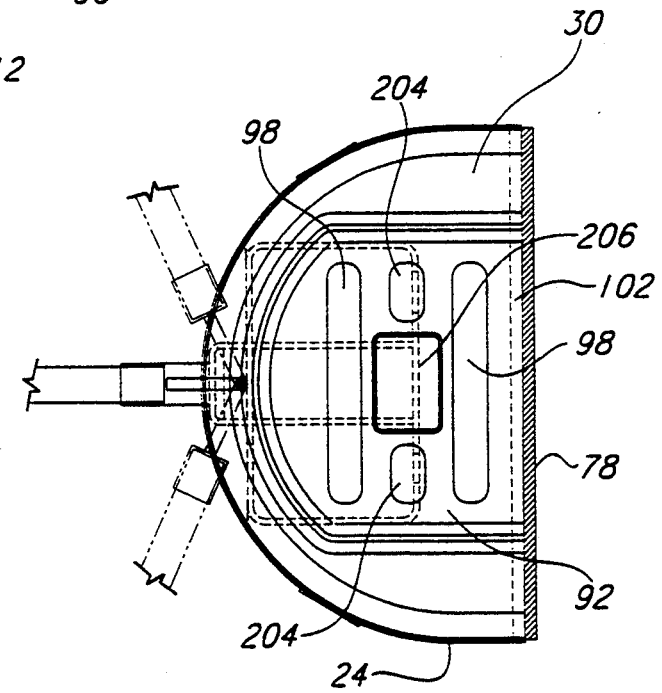
FIG. 7 is a top view of the enclosure of FIG. 6.
Figure 6:
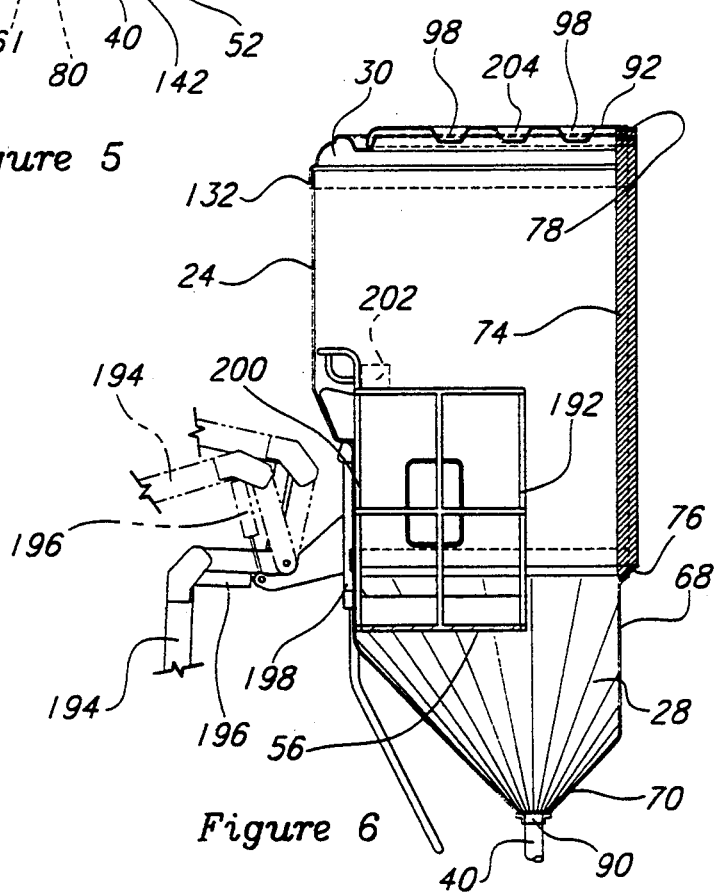
FIG. 6 is an enlarged cross-section side view of an alternative embodiment of the enclosure of FIG. 1 shown coupled to an adjustable boom arm.

Referring now to FIGS. 6 and 7, an alternative embodiment of the apparatus 10 of the present invention is shown wherein a moveable work platform 192 surrounded by the rigid enclosure 24 is coupled to an adjustably movable boom arm 194. For ease of understanding, the components of this alternative embodiment will be similarly numbered with those of the first embodiment when of a similar construction. Only the differences in construction will be described in detail. The boom arm 194 is moved by a hydraulic actuator 196, and is securely attached to the enclosure 24 by an attachment member 198. The attachment member 198 is secured to rear tubular frame members 200 of work platform 192.

A controller 202 is mounted to the work platform 192 and connected to the boom arm 194 such that a worker in the work platform 192 may control the movement of boom arm 194, thereby controlling the position of the enclosure 24 relative to the work surface to provide a sufficient seal and barrier through which effluents may not penetrate into the surrounding environment area.

The top panel 30 of this embodiment includes two additional reinforcing indentations 204 and a viewing window 206.

The illustrated embodiments of the apparatus 10 may be used for a variety of processes wherein airborne particulates or liquid are applied to a work surface or removed therefrom; e.g., blasting and painting the water tank 16, while containing all the particulates and resulting effluents within the enclosure 24. Such an operation includes positioning the self-propelled apparatus 10 to a desired location and position against the work surface. When the worker maneuvers the apparatus 10 properly against the work surface, utilizing the controller 64 or 202, the rigid enclosure 24 is against the work surface with the flexible seals 74, 76 and 78 in sealing contact with the work surface.

When the rigid enclosure 24 is positioned against work structure, a negative pressure is generated within the enclosure by drawing a vacuum through the vacuum conduit 34. This negative pressure and the seal formed between the rigid enclosure 24 and the work surface prevent objectionable debris from entering the atmosphere.

The enclosed worker may reposition the moveable enclosure 24 and the work platform 22 therein to a next work surface portion as desired by activating the controller 64 or 202 without leaving the enclosure. Upon completion of the operation or any portion thereof, the negative pressure within the enclosure 24 may be terminated, and the enclosure moved to a desired exit position, such as the ground, to allow the worker to exit the enclosure.

Numerous modifications and variations of the self-propelled work platform and containment enclosure disclosed herein will occur to those skilled in the art in view of this disclosure. Therefore, it is to be understood that these modifications and variations, and equivalents thereof, may be practiced while remaining within the spirit and the scope of the invention as defined by the following claims.

We claim:

1. A work platform apparatus attachable to positioning means, comprising:

a personnel basket sized to receive and support a worker therein, said personnel basket having a work platform positioned therein to support the worker, said personnel basket being directly supported by the positioning means;

a rigid shell releasably carried by said personnel basket, said rigid shell being shaped to define an interior area with said personnel basket contained within said interior area, said rigid shell having a front side portion shaped to fit against a work surface and to form a first substantially fluid tight seal therebetween, said front side portion having an access opening providing direct access to said interior area, said access opening being adjacent to said personnel basket to provide the worker with direct access to the work surface for the removal or addition of surface covering material, said rigid shell and said personnel basket being movable as a unit by the positioning means relative to the work surface;

a vacuum conduit connected to said rigid shell, said vacuum conduit being positioned to remove blasting media and surface covering material that are airborne within said interior area by creating a negative pressure inside said rigid shell;

a supply conduit to transport blasting media or surface covering material to an applicator within said rigid shell and controlled by the worker;

a funnel-shaped collector attached to a bottom portion of said rigid shell and positioned to receive spent blasting media and any surface covering material dislodged by the blasting media and falling within said rigid shell;

a return conduit connected to said funnel-shaped collector to transport the spent blasting media and any surface covering material dislodged by the blasting media out of said interior area and away from said interior area; and an air supply within said interior area to supply breathable air to the worker.

2. The apparatus according to claim 1 wherein said funnel shaped collector has a front side edge at a bottom side of said access opening, said front side edge being shaped to conform to and engage the work surface and form a seal therebetween along said bottom side of said access opening.

3. The apparatus according to claim 1 wherein said front side portion includes a flexible seal extending around said access opening.

4. The apparatus according to claim 1 wherein said rigid shell further includes at least one view port for viewing into and out of said rigid shell.

5. The apparatus according to claim 1, further including a hinged hatch in a top side of said rigid shell sized for passage of the worker therethrough.

6. The apparatus according to claim 1 wherein said rigid shell has a body portion with a semi-cylindrical shape.

7. The apparatus according to claim 6 wherein said body portion has a plurality of panel sections coupled together.

8. The apparatus according to claim 1 for use when the positioning means is a boom having a boom control mechanism, the apparatus further including an attachment member directly attachable to the boom, and a position-controller within said interior area adjacent to said personnel basket for manual operation by the worker, said position controller being coupled to the boom control mechanism to enable the worker to selectively position said rigid shell relative to the work surface.

9. A work platform comprising:

a moveable personnel basket sized to receive and support a worker therein, said personnel basket having a lower basket section with a support platform positioned to support the worker within the personnel basket, said lower basket said lower basket section having a first cross-sectional area:

a rigid shell carried releasably by said personnel basket and containing said personnel basket therein, said rigid shell having a front side portion shaped to fit against a work surface and to form a substantially fluid-tight seal therebetween, said front side portion having an access opening immediately adjacent to said personnel basket to provide the worker with direct access to the work surface for the removal or addition of surface covering material, said rigid shell and said personnel basket being attached together to move as a unit, said rigid shell having a body portion, a funnel shaped portion positioned below and attached to said body portion, and a top portion positioned above and attached to said body portion, said funnel-shaped portion having a lower funnel portion and an upper funnel portion, said upper funnel portion having a second cross-sectional area and containing at least a portion of said lower basket section with said support platform positioned within said upper funnel portion, said first cross section area of said lower basket section being smaller in area size than said second cross-sectional area of said upper funnel portion to permit blasting media and any dislodged surface covering material to fall past said personnel basket and into said lower funnel portion;

a flexible seal extending around said front side portion outward of said access opening to maintain the fluid tight seal between said rigid shell and the work surface;

a collector conduit attached to said lower funnel portion of said funnel shaped portion to receive and transport spent blasting media and any surface covering material dislodged by the blasting media away from said rigid shell;

a pressurized blasting media supply conduit to transport the blasting media to the worker within said rigid shell;

an air supply hose extending to said rigid shell to provide the worker with breathable air;

a vacuum conduit coupled to said rigid shell to create a negative pressure within said rigid shell; and a controller within said rigid shell to permit the worker to control movement of said work platform and position said rigid shell relative to the work surface.

10. The apparatus according to claim 9 wherein said body portion includes at least one translucent panel.

11. The apparatus according to claim 9 wherein the apparatus further includes ground engaging skids to support the apparatus when positioned on the ground.

12. The apparatus according to claim 11, wherein said ground engaging skids are adjacent to said funnel-shaped portion and positioned to support said lower funnel portion above the ground to provide clearance for said collector conduit to prevent said collector conduit from binding when the apparatus is resting on the ground.

13. The apparatus according to claim 9, further including at least one cable extending through said top portion of said rigid shell and directly attached to said personnel basket to move the apparatus in response to the worker's operation of said controller while within said personnel basket.

14. The apparatus according to claim 9, further including a boom directly attached to said personnel basket to move the apparatus in response to the worker's operation of said controller while within said personnel basket.

15. The apparatus according to claim 9 wherein said top portion of said rigid shell includes a hatch openable for the worker while inside said personnel basket to view the work surface above said rigid shell.

16. A method of cleaning a large work surface using a blasting media while fully containing all of the spent blasting media and the debris dislodged by the blasting media, comprising:

positioning a moveable personnel basket releasably carrying a rigid shell containing said personnel basket therein to a desired position against a work surface, with a side of said rigid shell having an access opening immediately adjacent to said personnel basket, said access opening having a sealing portion extending thereabout in sealing contact with the work surface to form a substantially fluid tight seal therebetween;

positioning a worker in said personnel basket and fully within said rigid shell, with the worker having direct access to the work surface through said access opening;

directing blasting media controlled by the worker from within said rigid shell through said access opening against the portion of the work surface exposed by said access opening;

collecting the spent blasting media and any dislodged debris in a funnel attached to a lower end of said rigid shell;

returning via a collector conduit connected to said funnel the spent blasting media and any dislodged debris to ground level for separation of the blasting media and the debris;

returning the separated blasting media via a return conduit to the worker within said rigid shell for reuse as blasting media:

supplying the worker via an air supply hose with breathable air;

applying via a vacuum conduit connected to said rigid shell a negative pressure inside said rigid shell and maintaining the substantially fluid tight seal between the work surface and said sealing portion of said rigid shell;

preventing the spent blasting material and any dislodged ed debris from exiting said rigid shell except through said collector conduit connected to said funnel-shaped portion and through said vacuum conduit; and repositioning said moveable personnel basket and said rigid shell to expose a different portion of the work surface to said access opening, with the repositioning being controlled by the worker using a controller while within said personnel basket.

17. The method of claim 16, further comprising:

terminating the application of said negative pressure inside said rigid shell; and moving said moveable personnel basket and rigid shell to a position that enables the worker to leave said personnel basket and exit from said rigid shell.

18. The method of claim 17, further comprising:

removably attaching said rigid shell to said personnel basket before positioning said personnel basket and said rigid shell in the desired position against the work surface; and removing said rigid shell from said personnel basket when said rigid shell and said personnel basket are in the position that enables the worker to leave said personnel basket and exit from said rigid shell.

19. A work platform apparatus attachable to positioning means, comprising:

a personnel basket sized to receive a worker therein, said personnel basket being directly connected to the positioning means and being moveable by the positioning means;

a rigid shell removably connected to and supported by said personnel basket, said rigid shell being sized to contain said personnel basket therein with the worker in said personnel basket, said rigid shell having an open front side portion shaped to fit against a work surface and to form a substantially fluid tight seal therebetween, said open front side portion being positioned immediately adjacent to said personnel basket with said open front side portion providing the worker with direct access to the work surface for removal or addition of surface covering material;

a vacuum conduit coupled to said rigid shell to create negative pressure inside said rigid shell;

a supply conduit to transport blasting media or surface covering material to an applicator within said rigid shell, said application being engageable and controllable by the worker;

a blasting media collection means to receive spent blasting media and any surface covering material that is dislodged by the blasting media; and a collection conduit connected to said blasting media collection means to transport the spent blasting media and any surface covering material dislodged by the blasting media away from said rigid shell.

20. The apparatus according to claim 19 wherein said blasting media collection means includes a funnel-shaped collector attached to a bottom portion of said rigid shell, said funnel-shaped collector being positioned below said open front side portion to receive spent blasting media and any surface covering material dislodged by the blasting media and falling within said rigid shell.

21. The apparatus according to claim 20 wherein said funnel-shaped connector is formed integral with said rigid shell.

22. The apparatus according to claim 20 further including ground support skids connected to said funnel-shaped collector, said ground support skids being positioned to support the apparatus on the ground with the funnel-shaped collector a selected distance above the ground to prevent said collector conduit from binding.

23. The apparatus according to claim 19, further including a position-controller within said rigid shell and being positioned for operation by the worker while in said personnel basket, said position-controller being operatively connected to the positioning means to enable the worker to selectively position said rigid shell relative to the work surface.

24. The apparatus according to claim 19 wherein the positioning means includes at least one support cable, and said personnel basket is directly connected to said support cable.

25. The apparatus according to claim 19 wherein the positioning means includes a boom and said personnel basket is directly connected to said boom.

26. The apparatus according to claim 19 further including an air supply to supply breathable air to the worker within said personnel basket.

27. The apparatus according to claim 19 wherein said blasting media collection means include a flat front side edge shaped to conform to and engage the work surface and form a seal therebetween to prevent spent blast material or any dislodged surface covering material from exiting said rigid shell between said rigid shell and the work surface at said front side edge.

* * * * *

UNITED STATES PATENT AND TRADEMARK OFFICE

CERTIFICATE OF CORRECTION

| | | |
|---|---|---|
| PATENT NO. | : | 5,427,199 |
| DATED | : | June 27, 1995 |
| INVENTOR(S) | : | Clay Jorgensen, Marl Kane, and Don Sybil |

It is certified that error appears in the above identified patent and that said Letters Patent is hereby corrected as shown below:

In column 11, claim 9, line 16, please delete the first occurrence of "said lower basket".

In column 12, claim 16, line 65, after "lodged" and before "debris", please delete "ed".

Signed and Sealed this

Twenty-eighth Day of November 1995

*Attest:*

Bruce Lehman

BRUCE LEHMAN

*Attesting Officer*

*Commissioner of Patents and Trademarks*